US008806891B2

(12) United States Patent
Brendeng et al.

(10) Patent No.: US 8,806,891 B2
(45) Date of Patent: Aug. 19, 2014

(54) METHOD FOR LIQUEFACTION OF GAS

(75) Inventors: Einar Brendeng, Trondheim (NO); Petter Nekså, Trondheim (NO)

(73) Assignee: Sinvent AS, Trondheim (NO)

( * ) Notice: Subject to any disclaimer, the term of this patent is extended or adjusted under 35 U.S.C. 154(b) by 1074 days.

(21) Appl. No.: 12/447,978

(22) PCT Filed: Nov. 1, 2007

(86) PCT No.: PCT/NO2007/000386

§ 371 (c)(1),
(2), (4) Date: Jun. 18, 2009

(87) PCT Pub. No.: WO2008/054229

PCT Pub. Date: May 8, 2008

(65) Prior Publication Data

US 2010/0058802 A1 Mar. 11, 2010

(30) Foreign Application Priority Data

Nov. 1, 2006 (NO) ..... 20065003

(51) Int. Cl.
*F25J 1/00* (2006.01)

(52) U.S. Cl.
USPC ..... 62/611; 62/612

(58) Field of Classification Search
USPC ..... 62/606, 611, 612, 613
See application file for complete search history.

(56) References Cited

U.S. PATENT DOCUMENTS 2,041,745 A 5/1936 Dreyfus
3,364,685 A * 1/1968 Perret ..... 62/612

(Continued)

FOREIGN PATENT DOCUMENTS

DE 4308509 9/1994

OTHER PUBLICATIONS

International Search Report mailed Feb. 22, 2008 for International Application No. PCT/NO2007/000386.

(Continued)

*Primary Examiner* — John F Pettitt
*Assistant Examiner* — Ignacio E Landeros
(74) *Attorney, Agent, or Firm* — Wenderoth, Lind & Ponack, L.L.P.

(57) ABSTRACT

The present invention relates to a process plant and method for cooling and optionally liquefaction of a product gas, particularly for liquefaction of natural gas, based on a closed loop of multi-component refrigerant in heat exchange with the gas to be cooled and optionally condensed. The process plant is comprises at least one primary heat exchanger (20) arranged to cool the product gas directed to the heat exchanger (10), at least one compressor (46) arranged to compress the low level refrigerant directed from the first of the at least two secondary heat exchangers (64), at least one pre-cooling heat exchanger (54) to sub-cool and partly liquefy the compressed refrigerant, at least one phase-separator (60) arranged to separate the partly liquefied multi-component refrigerant into a more volatile fraction and a less volatile fraction, at least two secondary heat exchangers (64, 114), the first of the at least two secondary heat exchangers (64) arranged to cool the more volatile fraction from the phase-separator (62), and the second of the at least two secondary heat exchangers (114) arranged to cool further the more volatile fraction, a throttling device (118) arranged to reduce the pressure of a part of the more volatile fraction to become the low level refrigerant to be heat exchanged in the second of at least two secondary heat exchangers, a throttling device (76) arranged to reduce the pressure of a part of the more volatile fraction to become the low level refrigerant to be heat exchanged in the at least one primary heat exchanger (20), a throttling device (102) arranged to reducing the pressure of the less volatile fraction from the at least one phase-separator (60) to become part of the low level refrigerant, for mixing with the low level refrigerant from the at least one primary heat exchanger (20), and the low level refrigerant from the second of at least two secondary heat exchangers (114) this directed to heat exchange through the first of at the least two secondary heat exchangers (64).

7 Claims, 5 Drawing Sheets

(56) References Cited

U.S. PATENT DOCUMENTS

| | | | | |
|---|---|---|---|---|
| 3,593,535 | A | 7/1971 | Gaumer, Jr. | |
| 3,668,882 | A | 6/1972 | Sarsten et al. | |
| 3,932,154 | A | 1/1976 | Coers et al. | |
| 5,512,084 | A * | 4/1996 | Mauterer | 95/199 |
| 5,701,761 | A * | 12/1997 | Prevost et al. | 62/613 |
| 6,347,532 | B1 * | 2/2002 | Agrawal et al. | 62/612 |
| 6,751,984 | B2 * | 6/2004 | Neeraas et al. | 62/612 |
| 2003/0019240 | A1 | 1/2003 | Neeraas et al. | |
| 2007/0193303 | A1 * | 8/2007 | Hawrysz et al. | 62/612 |

OTHER PUBLICATIONS

International Preliminary Report on Patentability mailed Feb. 10, 2009 for International Application No. PCT/NO2007/000386.

* cited by examiner

METHOD FOR LIQUEFACTION OF GAS

FIELD OF INVENTION

The present invention relates to a method for liquefaction of gas, particularly natural gas, using multi-component refrigerant.

BACKGROUND

Liquefaction of gas, particularly natural gas, is well known from larger industrial plants, so called "baseload" plants, and from peak shaving plants. Such plants have the property in common that they convert a substantial quantum gas pr unit of time, so they can bear a significant upfront investment. The costs pr, gas volume will still be relatively low over time. Multi-component refrigerants are commonly used for such plants, as this is the most effective way to reach the sufficiently low temperatures.

Kleemenko (10th International Congress of Refrigeration, 1959) describes a process for multi-component cooling and liquefaction of natural gas, based on use of multi-flow heat exchangers.

U.S. Pat. No. 3,593,535 describes a plant for the same purpose, based on three-flow spiral heat exchangers with a an upward flow direction for the condensing fluid and a downward flow direction for the vaporizing fluid.

A similar plant is known from U.S. Pat. No. 3,364,685, in which however the heat exchangers are two-flow heat exchangers over two steps of pressure and with flow directions as mentioned above.

U.S. Pat. No. 2,041,745 describes a plant for liquefaction of natural gas partly based on two-flow heat exchangers, where the most volatile component of the refrigerant is condensed out in an open process. In such an open process it is required that the gas composition is adapted to the purpose. Closed processes are generally more versatile. There is however, a need for liquefaction of gas, particularly natural gas, many places where it is not possible to enjoy large scale benefits, for instance in connection with local distribution of natural gas, where the plant is to be arranged at a gas pipe, while the liquefied gas is transported by trucks, small ships or the like. For such situations there is a need for smaller and less expensive plants.

Small plants will also be convenient in connection with small gas fields, for example of so called associated gas, or in connection with larger plants where it is desired to avoid flaring of the gas. In the following the term "product gas" is used synonymously with natural gas or another gas to be liquefied.

For such plants it is more important with low investment costs than optimal energy optimization. Furthermore a small plant may be factory assembled and transported to the site of use in one or several standard containers.

U.S. Pat. No. 6,751,984, by the same applicant as the present invention, describes a concept for small scale liquefaction of product gas. The concept is based on two-flow heat exchangers with a downward flow direction for the condensing fluid and an upward flow direction for the vaporizing fluid. The cooling is taking place at essentially one pressure level. The shortcoming of this process is however that it requires many heat exchangers for realizing the process, and at least two primary heat exchangers serially connected for condensing the product gas. This makes the process somewhat complex and then less suitable for use in some applications.

OBJECTIVE

It is thus an object of the present invention to provide a method and a process plant for the liquefaction of gas, particularly natural gas, which is adapted for small scale liquefaction. It is furthermore an object to provide a plant for the liquefaction of gas for which the investment costs are modest.

It is thus a derived object to provide a method and a small scale process plant for cooling and liquefaction of gas, particularly natural gas, with a multi-component refrigerant, where the plant is solely based on conventional two-flow heat exchangers and preferably conventional oil lubricated compressors.

It is furthermore a derived object to provide a small scale plant for the liquefaction of natural gas, which plant may be transported factory assembled to the site of use. Further it is an object to provide a simplified concept compared to known concepts, to further reduce cost, ease operation and maintenance and thereby increase the applicability.

THE INVENTION

The above mentioned objects are achieved by a method according to a first aspect of the invention and a plant according to a second aspect of the invention.

Preferred and alternative embodiments of the method and the plant according to the invention are disclosed according to additional aspects of the invention.

With the plant according to the invention there is obtained a small scale plant for cooling and liquefaction, where the plant costs is not prohibitive of a cost-effective operation. By the way with which the components of the plant are combined, it is avoided that oil from the compressors, which to some extent will contaminate the refrigerant, follows the flow of refrigerant to the coldest parts of the plant. It is thus avoided that the oil freezes and plugs conduits etc.

In the concept according to U.S. Pat. No. 6,751,384 it was necessary to include equipment for distribution of refrigerant between pairs of heat exchangers in separate rows. In the present concept no special equipment for refrigerant distribution between parallel pairs of heat exchangers is needed. The product gas is cooled, liquefied and/or sub-cooled in one heat exchanger, preferably a plate heat exchanger, denoted primary heat exchanger, while the multi-component refrigerant is cooled, partly liquefied and further liquefied and/or sub-cooled in two heat exchangers, denoted secondary heat exchangers. The primary and secondary heat exchangers may or may not be of same type and have similar dimensions, and the number of channels will depend upon the flow rate through the heat exchangers. Use of multi-component refrigerant is known per se, while achieving the benefits inherent with being able to reach very low temperatures in a simple plant, based on conventional components in this simple way, is not. With the plant according to the invention it is also possible to obtain a natural flow direction in the plant, namely so that evaporating fluid moves upward while condensing fluid moves downward, avoiding that gravity negatively interferes with the process. However, the invention is not limited to this, as other configurations are equally possible.

DETAILED DESCRIPTION OF THE INVENTION

Figure 1:
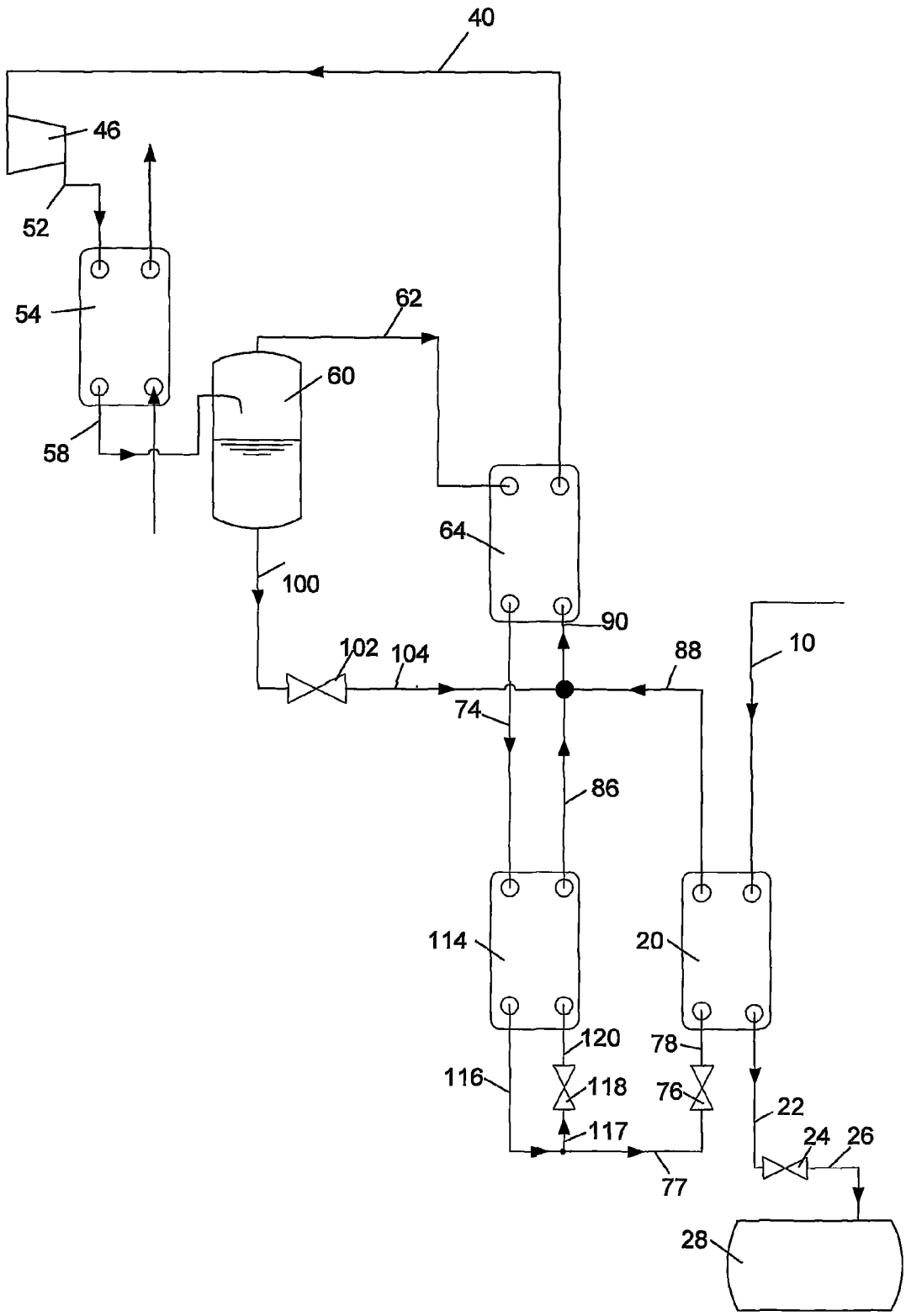
FIG. 1 shows a flow diagram of a process plant according to the invention.

A feed flow of gas, e.g. of natural gas is supplied through conduit 10. This raw material is brought down to a temperature of e.g. between approximately −10° C. and 20° C. and with a pressure as high as allowable for the plate heat exchanger in question, e.g. 30 barg. The natural gas has been pre-dried and $CO_2$ has been removed to a level where no solidification occurs in the heat exchanger. The product gas is cooled in the primary heat exchanger 20 to about −130 to −160° C., typically −150° C., by heat exchange with low level (low pressure) refrigerant that is supplied to the heat exchanger through conduit 78 and departs from the heat exchanger through conduit 88. In heat exchanger 20 the product gas is cooled to a temperature low enough to ensure low or no vaporizing in the subsequent throttling to the pressure of the storage tank 28. The temperature may typically be −136° C. at 5 bara or −156° C. at 1,1 bara in the storage tank 28, and the natural gas is led to the tank through throttle device 24 and conduit 26. The low level refrigerant supplied to heat exchanger 20 through conduit 78 is at its coldest in the process plant, and comprises only the most volatile parts of the refrigerant.

Low level refrigerant in conduit 40 coming from heat exchanger 64 where it is used for cooling high level refrigerant is led to at least one compressor 46 where the pressure increases to typically 20 barg. The refrigerant then flows through conduit 52 to a heat exchanger 54 where all heat absorbed by the refrigerant from the natural gas in the steps described above, is removed by heat exchange with an available sink, like cold water or a pre-cooling plant. The refrigerant is thereby cooled to a temperature of typically about 20° C., possibly lower by means of pre-cooling, and partly condensed. From here on, the refrigerant flows through conduit 58 to a phase separator 60, where the most volatile components are separated out at the top through conduit 62. This part of the refrigerant constitutes the high level refrigerant to secondary heat exchanger 64. In heat exchanger 64 the high level refrigerant from conduit 62 is cooled and partly condensed by the low level refrigerant that is supplied to heat exchanger 64 through conduit 90 and departs from the same through conduit 40. From heat exchanger 64 the high level refrigerant flows through conduit 74 to a second secondary heat exchanger 114 arranged in parallel with primary heat exchanger 20. In heat exchanger 114 the high level refrigerant from conduit 74 is cooled and partly or fully condensed by low level refrigerant that is supplied to heat exchanger 114 through conduit 120 and departs from the same through conduit 86.

From heat exchanger 114 the partly or fully condensed high level refrigerant flows through conduit 116 to throttle devices 76 and 118 for throttling to a lower pressure. The flow through device 76 flows from this point as low level refrigerant through conduit 78 to the heat exchanger 20 where the liquefaction of the process gas takes place. The refrigerant in conduit 78 is thus at the lowest temperature of the entire process, and about equally cold as in conduit 120, typically in the range −140° C. to −160° C.

Parts of the partly condensed, condensed or sub-cooled high level refrigerant in conduit 116 is directed to the second secondary heat exchanger 114 subsequent to having been throttled to low pressure through a throttle device 118. This refrigerant flows through conduit 120 to heat exchanger 114 where it is used to cool the high level refrigerant before leaving the heat exchanger through conduit 86.

From the phase separator 60, the less volatile part of the refrigerant flows through conduit 100, is throttled to a lower pressure through throttle device 102, is mixed with flows of low level refrigerant from conduits 86 and 88 leaving heat exchangers 114 and 20 respectively, where after the joined flow of low level refrigerant flows on to heat exchanger 64 through 90.

Together with the less volatile fraction of the refrigerant in conduit 100 there will always be some contaminations in the form of oil when ordinary oil cooled compressors are used. It is thus a feature of the present invention that this first, less volatile flow 100 of refrigerant from the phase separator 60 only is used for heat exchange in the heat exchanger 64 that is least cold, as heat exchanger constitutes the first cooling step of the refrigerant. The low level refrigerant flowing upwards through the pair of heat exchangers arranged in parallel, denoted primary heat exchangers for cooling of the product gas and secondary heat exchanger for cooling of high level refrigerant, will be heated and partly evaporated by the heat received from the product gas and from the high level refrigerant. The flow of low level refrigerant is for the pair of heat exchangers 114 and 20 split in to partial flows which are thereafter joined again, having essentially the same pressure. It is convenient that the two flows of high level refrigerant leaving the pair of heat exchangers can be controlled in temperature, i.e. that the temperature of high level refrigerant in conduit 116 is approximately in the same range as the temperature of the product gas in conduit 22. This can be achieved by suitable control of throttle devices 118, 76 and 24.

Figure 2:
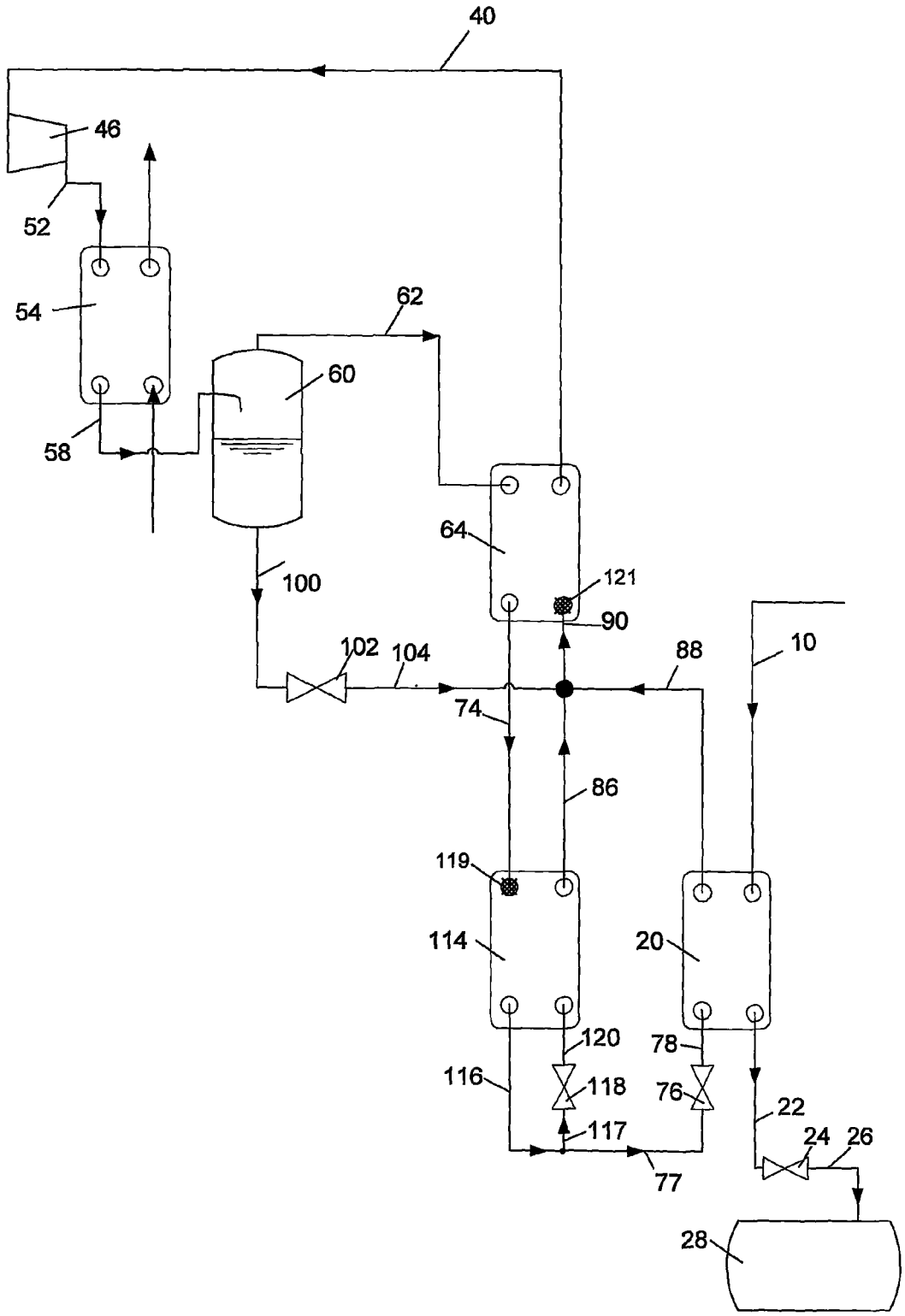
FIG. 2 shows an alternative embodiment of the plant of FIG. 1.

FIG. 2. shows an alternative embodiment of the plant of FIG. 1. The high level refrigerant flow in conduit 74 will be in the two-phase state at the inlet to heat exchanger 114. In order to achieve a satisfactory refrigerant distribution between the parallel channels in the heat exchanger 114, a static mixing device 119 could be inserted in the conduit 74 at the heat exchanger inlet port. The efficiency of static mixers increases with increasing pressure drop, and a pressure drop of e.g. 1 bar could be permitted on the high level refrigerant side. The low level refrigerant flow in conduit 90 will be in the two-phase state at the inlet to heat exchanger 64. In order to achieve a satisfactory refrigerant distribution between the parallel channels in the heat exchanger 64, a static mixing device 121 could be inserted in the conduit 90 at the heat exchanger inlet port. Since any substantial pressure drop decreases the efficiency of the plant, the pressure drop in this mixer should be as low as practically possible.

Figure 3:
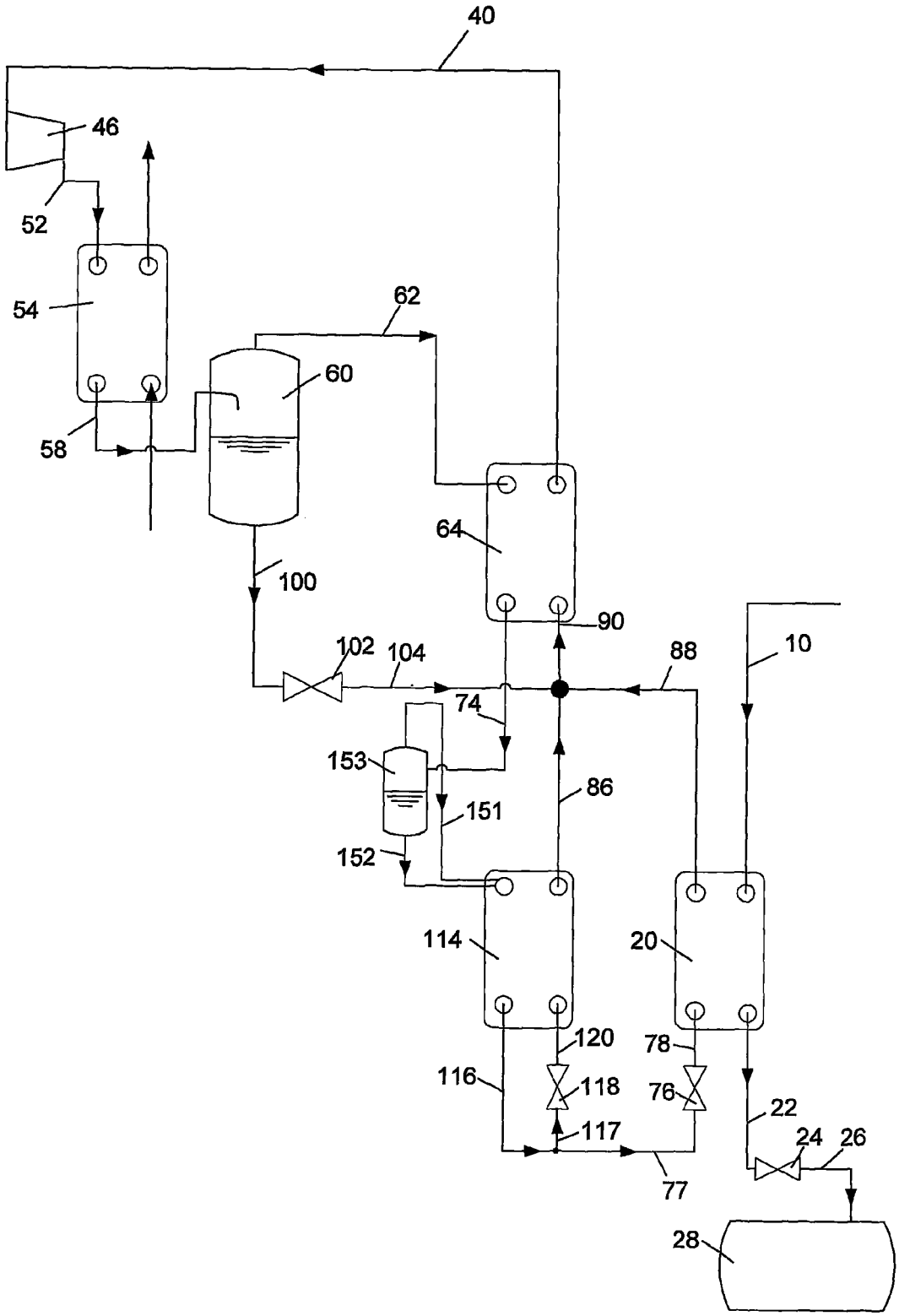
FIG. 3 shows an alternative embodiment of the plant of FIG. 1.

FIG. 3 shows an alternative embodiment of the plant of FIG. 1, where a separator 153 has been inserted in the high level refrigerant conduit 74. The two-phase refrigerant flow in conduit 74 is separated into a gas part, fed by conduit 151 to heat exchanger 114 inlet, and a liquid part, fed by conduit 152 to the same heat exchanger 114 inlet. A special distribution device, not shown, must be installed in the inlet port to distribute the liquid evenly between the parallel channels in the heat exchanger.

Figure 4:
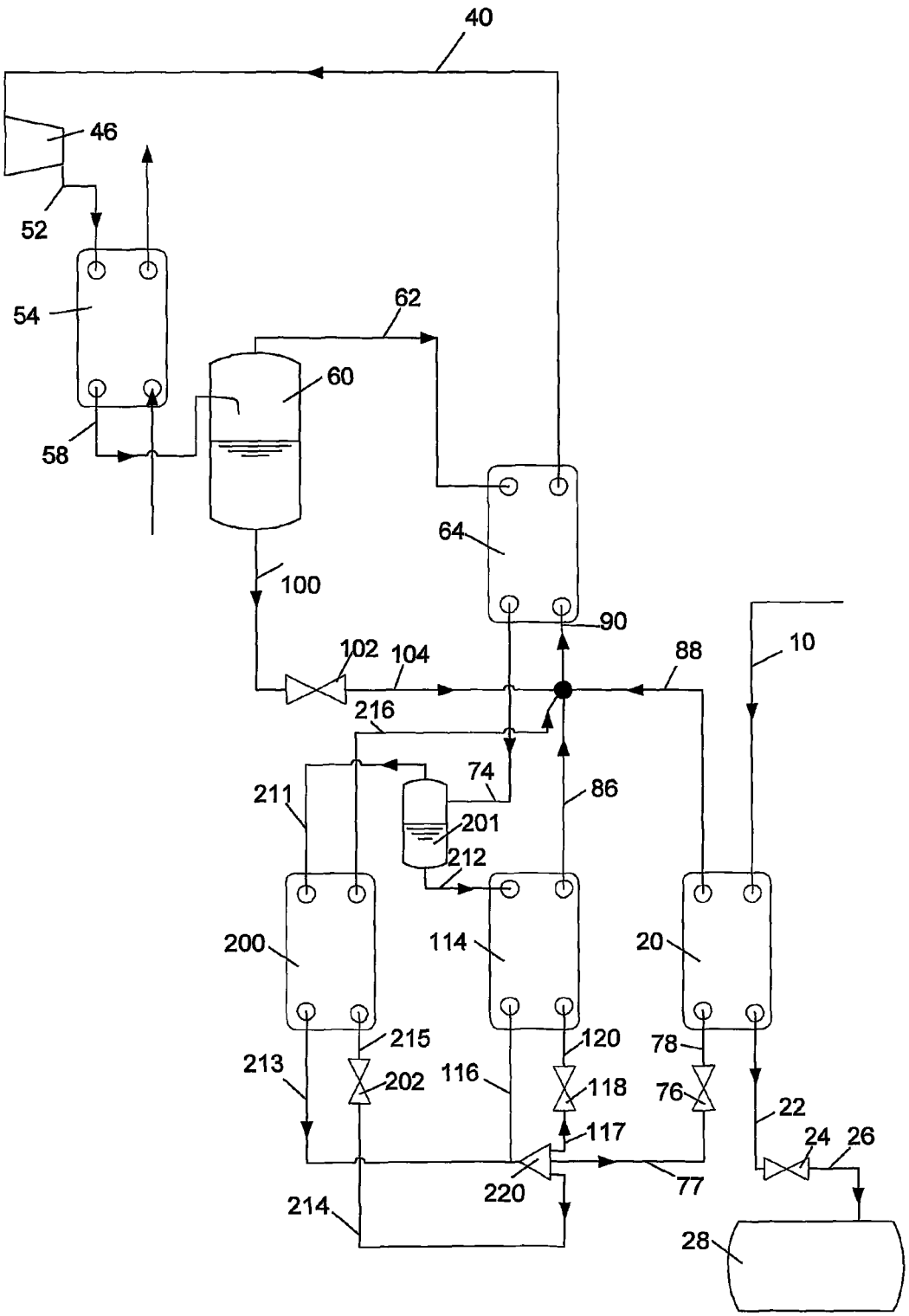
FIG. 4 shows an alternative embodiment of the plant of FIG. 1.

FIG. 4 shows an alternative embodiment of the plant of FIG. 1, where a separator 201 has been inserted in the high level refrigerant conduit 74. The two-phase refrigerant flow in conduit 74 is separated into a more volatile gas fraction, directed by conduit 211 to heat exchanger 200, and a less volatile liquid part, directed by conduit 212 to heat exchanger 114. The gas part is liquefied and possibly sub-cooled in heat exchanger 200, and the liquid is sub-cooled in heat exchanger 114. The liquid from heat exchanger 200 is conveyed in conduit 213 to a static mixer 220, and the liquid from heat exchanger 114 is conveyed in conduit 116 to the same mixer 220 for remixing of the two separate liquid streams. Further a part of the remixed more volatile liquid stream is directed in conduit 117 to the throttling device 118 and directed in conduit 120 into heat exchange in heat exchanger 114 as low level refrigerant. Another part of the remixed more volatile liquid stream is directed in conduit 214 to the throttling device 202 and directed in conduit 215 into heat exchange in heat exchanger 200 as low level refrigerant. Yet another part of the remixed more volatile liquid stream is directed in conduit 77 to the throttling device 76 and directed in conduit 78 as low level refrigerant into heat exchange with the product gas to be cooled in the primary heat exchanger 20.

Figure 5:
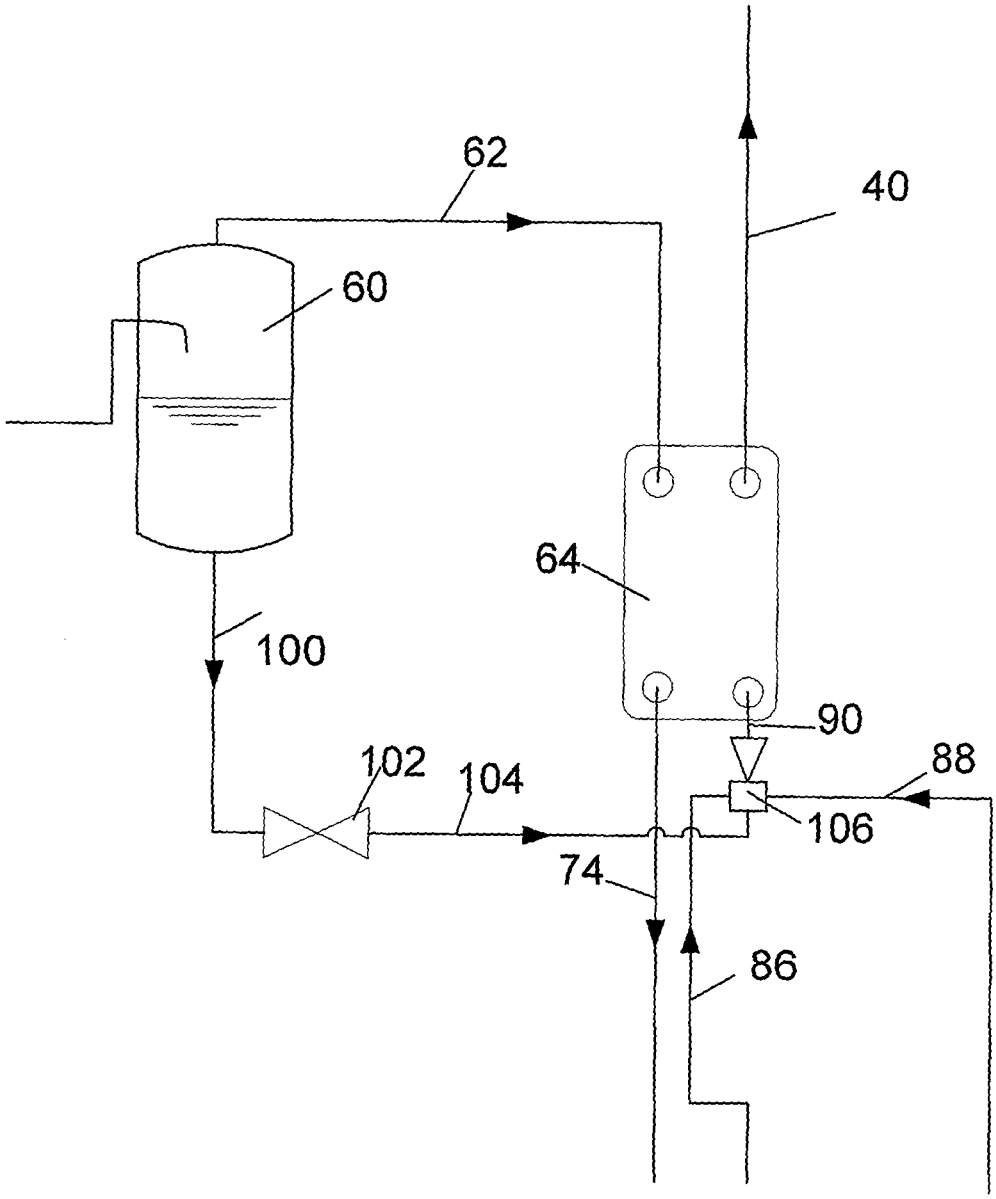
FIG. 5 shows a section of the plant of FIG. 1, with an alternative embodiment of a mixing device for the refrigerant

FIG. 5 shows a section of the plant of FIG. 1, comprising the phase separator 60, the secondary heat exchanger 64 (the first cooling step of refrigerant) and conduits 86 and 88 coming from heat exchangers 114/20. In addition FIG. 5 furthermore shows a combined ejector and mixing device 106 receiving the flows of refrigerant from conduits 86, 88 and 104, cf. FIG. 1, in which the velocity energy from the pressure reduction from a high to a low pressure level in conduit 104 is used to overcome the pressure loss in a mixer for fine dispersion of the liquid in the two-phase flow. On its downstream side the mixing device 106 feeds the flow to conduit 90 leading to the secondary heat exchanger 64 to obtain a good distribution of the two-phase flow in the parallel channels in the heat exchanger.

A controlling means, not shown, is interconnected between the phase separator 60 and the throttle device 102, which is continuously controlled in a way that ensures that the level of condensed phase in the phase separator is maintained between a maximum and a minimum level. This can also be combined with a control of the nozzle area in the ejector, manually or automatically by means of a processor controlled circuit.

While FIG. 1 only shows one compressor, it is often more convenient to compress the refrigerant in two serial steps, preferably with interconnected cooling. This has to do with the degree of compression efficiency obtainable with simple oil lubricated compressors, and may be adapted according to need by the skilled person.

Again with reference to FIG. 1 it may be convenient to include an additional heat exchanger as explained herein below. Since the low level refrigerant in conduit 40 normally will have a temperature lower than that of the high level refrigerant in conduit 58, it may be convenient to heat exchange these against each other (not shown), thus lowering the temperature of said high level refrigerant further prior to its introduction into phase-separator 60 via conduit 58.

By the method and the plant according to the invention it is provided a solution by which a product gas, like natural gas may be liquefied cost-effectively in small scale, as the processing means utilized are of a very simple kind. The controlling and adaptation of the process ensures that oil from the compressors contaminating the product gas can not freeze and plug conduits or heat exchangers, as the oil do not reach the coldest parts of the plant. The small scale liquefaction plant described herein may be used in several different applications, for partial or total liquefaction of a gas with low boiling temperature. The advantage of the plant is that it can be skid mounted or delivered in standard containers, that the energy consumption is fairly low, and that the delivery time may be shorter than for other small scale systems.

Various non-limiting examples of use of the method and plant according to the present invention may be:

Liquefaction of natural gas from gas pipe lines, for truck transport to remote users. The users can be permanent users where pipe distribution is not economically feasible. The small scale liquefaction plant can be delivered skid mounted to the actual site, and can be removed easily if the demand for LNG production is changed.

Liquefaction of natural gas from gas pipe lines, for vehicle fuel production. Truck transport of liquefied natural gas may in some cases be regarded as a risk for the environment, but with local fuel production truck transport of liquefied natural gas is avoided. The small scale liquefaction plant can be delivered skid mounted to the actual site, and can be removed easily if the demand for fuel production is changed.

Liquefied methane from landfills is of increasing interest as e.g. vehicle fuel. The small scale liquefaction plant described herein is well suited for this purpose, with comparatively low energy consumption, and low investment costs. The small scale liquefaction plant can be delivered skid mounted to the landfill site, and can be removed easily when the production of landfill gas is exhausted.

Also for liquefaction of digester gas the plant is well suited.

Liquefaction of remote natural gas from small gas wells, shut-in gas wells, and stranded gas. Since the gas reserves for small gas wells may be limited, the easy transportability of the small liquefaction plant will be of advantage. Further, the plant can be used for liquefaction of gas that else may have to be flared. The liquefied gas can be transported by truck to the consumers or to power plants for electricity production, thus making possible the use of natural gas in areas where it is not economically justified to build gas pipe lines.

Coal bed gas, consisting mainly of methane, is an important energy resource. For coal beds where a large number of wells must be drilled and the rate of gas production for each well is limited, the small scale liquefaction plant may be used to liquefy the methane, thus saving a valuable fuel for use for different purposes. Further, the reduction of methane emissions is important for the global warming contribution.

Reliquefaction of boil off gas from tanks onboard small tank ships, especially ships for transport of liquefied natural gas. For small gas tank ships for transport of liquefied natural gas only thermal oxidizing of the boil off gas has been considered so far, since other methods, as use of a reversed Brayton cycle, may be too costly and energy consuming in the small size needed.

Reliquefaction of boil off gas from on-shore tanks, as satellite liquefied natural gas tanks, where the gas demand varies, and at times may be lower than the boil off gas rate.

The invention claimed is:

1. A method for cooling and optionally liquefaction of a product gas, based on a closed loop of multi-component refrigerant with a joined composition of a more volatile fraction and a less volatile fraction, in heat exchange with the product gas to be cooled and optionally condensed, said method comprising:

directing the product gas to be cooled through a primary two-flow heat exchanger;

directing the refrigerant with the joined composition from a first secondary two-flow heat exchanger through a compressor;

removing heat absorbed by the refrigerant by heat exchange in a pre-cooling heat exchanger so as to cool the refrigerant;

passing the cooled refrigerant into a first phase-separator for separating the refrigerant into the more volatile fraction and the less volatile fraction;

cooling the more volatile fraction in heat exchange with low pressure refrigerant of the joined composition by passing the more volatile fraction through the first secondary two-flow heat exchanger;

further cooling the more volatile fraction in heat exchange through a second secondary two-flow heat exchanger;

directing a first part of the further cooled more volatile fraction to a first throttling device, and directing the first part from the first throttling device into heat exchange in the second secondary two-flow heat exchanger as a first low pressure refrigerant;

directing the remaining part of the further cooled more volatile fraction to a second throttling device so as to become a remaining low pressure refrigerant, and directing the remaining low pressure refrigerant into heat exchange with the product gas to be cooled through the primary two-flow heat exchanger;

throttling by means of a third throttling device the less volatile fraction from the first phase-separator so as to become a second low pressure refrigerant, and directing all of the second low pressure refrigerant, combined with the remaining low pressure refrigerant from the primary heat exchanger and the first low pressure refrigerant from the second secondary two-flow heat exchanger, into heat exchange and complete vaporization through the first secondary two-flow heat exchanger, wherein the second low pressure refrigerant with the less volatile fraction, the first low pressure refrigerant with the first part of the more volatile fraction and the remaining low pressure refrigerant with the remaining part of the more volatile fraction form the total amount of the joined composition; and closing the loop by directing the vaporized refrigerant to the compressor, wherein only the primary two-flow heat exchanger receives the product gas, and wherein only the refrigerant is passed through the first and second secondary two-flow heat exchangers.

2. The method according to claim 1, wherein said directing of the product gas to be cooled through the primary two-flow heat exchanger also includes directing the cooled product gas through a fourth throttling device to a storage tank.

3. The method according to claim 1, further comprising:

after said cooling of the more volatile fraction and before said further cooling of the more volatile fraction, mixing gas and liquid in the second secondary two-flow heat exchanger by means of a mixing device at a high level inlet port of the second secondary two-flow heat exchanger.

4. The method according to claim 1, wherein a mixing device is arranged between the first and second secondary two-flow heat exchangers in order to achieve a better distribution of gas and liquid in the second secondary two-flow heat exchanger.

5. The method according to claim 1, further comprising:

after said cooling of the more volatile fraction and before said further cooling of the more volatile fraction, separating gas and liquid of the more volatile fraction in a second phase-separator arranged after the first secondary two-flow heat exchanger and then directing a gas part of the more volatile fraction and a liquid part of the more volatile fraction for remixing.

6. The method according to claim 1, further comprising:

after said cooling of the more volatile fraction and before said further cooling of the more volatile fraction, separating gas and liquid of the more volatile fraction in a second phase-separator arranged after the first secondary two-flow heat exchanger, wherein the second secondary two-flow heat exchanger comprises two parallel two-flow heat exchangers, wherein said further cooling of the more volatile fraction includes directing a gas part of the more volatile fraction to a first one of the parallel two-flow heat exchangers for liquefaction and directing a liquid part of the more volatile fraction to a second one of the parallel two-flow heat exchangers for sub-cooling, and then remixing separate liquid streams from the parallel two-flow heat exchangers in a mixing device, wherein said directing of the first part of the further cooled more volatile fraction from the first throttling device into heat exchange comprises directing the first part of the further cooled more volatile fraction from the first throttling device into heat exchange in one of the parallel two-flow heat exchangers as the first low pressure refrigerant, wherein said directing of the remaining part of the further cooled more volatile fraction comprises directing a second part of the further cooled more volatile fraction to a fourth throttling device, and directing the second part from the fourth throttling device into heat exchange in another of the parallel two-flow heat exchangers as a third low pressure refrigerant, and directing a third part of the further cooled more volatile fraction to the second throttling device so as to become the remaining low pressure refrigerant, and directing the remaining low pressure refrigerant into heat exchange with the product gas to be cooled through the primary two-flow heat exchanger, and wherein said directing of all of the second low pressure refrigerant comprises directing all of the second low pressure refrigerant combined with the remaining low pressure refrigerant from the primary heat exchanger and the first and third low pressure refrigerants from the parallel two-flow heat exchangers, into heat exchange and complete vaporization through the first secondary two-flow heat exchanger, and wherein the second low pressure refrigerant with the less volatile fraction, the first low pressure refrigerant with the first part of the more volatile fraction, the third low pressure refrigerant with the second part of the more volatile fraction and the remaining low pressure refrigerant with the third part of the more volatile fraction forms the total amount of the joined composition.

7. The method according to claim 1, further comprising:

prior to said directing of all of the second low pressure refrigerant combined with the remaining low pressure refrigerant and the first low pressure refrigerant into heat exchange and complete vaporization through the first secondary two-flow heat exchanger, using the second low pressure refrigerant from the first phase-separator as a driving fluid in an ejector to become a part of the total amount of the joined composition, and in order to obtain a pressure increase or mixing of the second low pressure refrigerant with the first low pressure refrigerant and the remaining low pressure refrigerant.

* * * * *